US005498162A

United States Patent [19]

Schaefer

[11] Patent Number: 5,498,162

[45] Date of Patent: Mar. 12, 1996

[54] METHOD FOR DEMONSTRATING A LIFTING TECHNIQUE

[75] Inventor: Michael J. Schaefer, Paynesville, Minn.

[73] Assignee: Risk Management, Consultant, Inc., Paynesville, Minn.

[21] Appl. No.: 301,353

[22] Filed: Sep. 6, 1994

[51] Int. Cl.[6] ..... G09B 19/00

[52] U.S. Cl. ..... 434/258; 434/247

[58] Field of Search ..... 434/258, 256, 434/248, 247; 482/901

[56] References Cited

U.S. PATENT DOCUMENTS 2,696,056 12/1954 Kistler et al. ..... 434/256
5,348,519 9/1995 Prince et al. ..... 482/6

OTHER PUBLICATIONS

Jon Smoker, Sumo Style Deadlift, Iron Man magazine, Nov. 1983.
Grimeek, Iron Man magazine Sep. 1987, p. 73.

*Primary Examiner*—Robert A. Hafer
*Assistant Examiner*—Michael O'Neill
*Attorney, Agent, or Firm*—Kinney & Lange

[57] ABSTRACT

A method for demonstrating lifting technique includes providing a substantially rectangular box in a first stationary position on a ground surface, inserting a first weight into the box, approaching the box in the first stationary position at approximately a 45° angle such that one's feet are wider than shoulder distance apart when one is adjacent the box, bending one's knees such that one's body is close to the box, and lifting the box from the first stationary position. The box has an internal storage area formed by a top wall, a bottom wall contacting the ground surface in the first stationary position and being movable to provide access to the internal storage area, a front wall, a back wall, and first and second opposed side walls. The first and second side walls each have handles thereon adjacent the top wall so that the box may be lifted with or without the handles. After lifting the box with the handles the first time, the method further includes returning the box to the first stationary position, inverting the box to a second stationary position wherein the top wall contacts the ground surface and wherein the handles are not readily accessible, approaching the box at approximately a 45° angle such that one's feet are wider than shoulder distance apart when one is adjacent the box, bending one's knees such that one's body is close to the box, and lifting the box without using the handles.

12 Claims, 4 Drawing Sheets

METHOD FOR DEMONSTRATING A LIFTING TECHNIQUE

BACKGROUND OF THE INVENTION

The present invention relates to methods for demonstrating techniques for lifting objects, and more particularly, to a method for demonstrating a lifting technique which reduces the likelihood of back injury.

Improper lifting techniques often result in back injuries. In addition, improper lifting techniques often decrease a person's potential lifting capacity. One traditional method for lifting objects is a technique known as the "backlift" (see FIG. 1). The backlift simply involves approaching an object, bending at the waist to grasp the object, and using the back muscles to return the body to an upright position. Backlifting stresses and strains the muscles, tendons and ligaments in the back and eventually causes a build-up of scar tissue and a permanent susceptibility to further back injuries.

Another traditional, well-known and often practiced method for lifting objects is a technique known as the "squatlift" (see FIG. 2). Squatlift training emphasizes placing the feet shoulder distance apart, keeping the back straight, and lifting with the legs. However, there are three inherent difficulties with this style of lifting. First, the lifter's heels quickly come off the floor and the lifter's body becomes unstably balanced on the balls of the feet. Second, the lifter's knees often get in the way of the object to be lifted, and the lifter is then forced to push the load farther away from the body's center of gravity than is desirable. The closer the load is held to the body the easier and less stressful the lift. Third, the squatlift requires the lifter's knee joints to be placed in a deep knee bend position wherein the angle between the upper leg and the lower leg is often less than 90°, thereby reducing the legs' efficiency and making it more difficult to unfold the knee from an angle less than 90° back to a 180° straight position. More particularly, the extremely short lever arm running from the patella (knee cap) to the tibial tuberosity (front of the shin bone) forces the quadricep muscles to work many times harder to hold the knee at any angle less than 90° compared to an angle greater than 90°.

SUMMARY OF THE INVENTION

The present invention provides a technique of lifting which eliminates the inherent difficulties and problems with the backlift and squatlift techniques. More particularly the present invention provides a method for demonstrating a lifting technique including the steps of providing a substantially rectangular box in a first stationary position on a ground surface, inserting a first weight into the box, approaching the box in the first stationary position at approximately a 45° angle such that one's feet are wider than shoulder distance apart when one is adjacent the box, bending one's knees such that one's body is close to the box, and lifting the box from the first stationary position.

In one embodiment, the box has an internal storage area formed by a top wall, a bottom wall contacting the ground surface in the first stationary position and being movable to provide access to the internal storage area, a front wall, a back wall, and first and second opposed side walls. The first and second side walls each have handles thereon adjacent the top wall so that the box may be lifted with or without the handles. After lifting the box with the handles the first time, the method further includes the steps of returning the box to the first stationary position, inverting the box to a second stationary position wherein the top wall contacts the ground surface and wherein the handles are not readily accessible, approaching the box at approximately a 45° angle such that one's feet are wider than shoulder distance apart when one is adjacent the box, bending one's knees such that one's body is close to the box, and lifting the box without using the handles.

The present invention also provides a method for demonstrating a lifting technique including providing one with a comparison kinesthetic POWERSTROKE experience, a comparison kinesthetic POWERLIFF stance experience, and a comparison kinesthetic POWERLIFF experience ("POWERSTROKE" and "POWERLIFT" are trademarks of Risk Management Consultants, Inc., Paynesville, Minn.). The comparison kinesthetic POWERSTROKE experience allows one to experience the amount of work required by the leg and knee to bend with a shoulder width stance compared to a wider than shoulder width stance. The comparison kinesthetic POWERLIFT stance experience allows one to experience the increase in strength derived from a wider than shoulder width stance compared to a shoulder width stance when supporting a load with one's hands and to experience the load shift from one's back to one's legs when a wider than shoulder stance is used. The comparison kinesthetic POWERLIFT experience involves lifting an object by approaching the object from approximately a 45° angle, spreading one's feet wider than shoulder width around the object, bending one's knees, positioning one's body close to the object, and lifting the object with one's legs compared to lifting the object with a stance shoulder width apart and without approaching the object from approximately a 45° angle.

DETAILED DESCRIPTION OF THE PREFERRED EMBODIMENTS

The present invention provides a method in which a teacher demonstrates to a group of students a lifting technique which reduces the likelihood of back injury. The demonstration involves the dissemination of information to the students using auditory, visual and kinesthetic modes. The demonstration provides a proper understanding of the mechanical and engineering principles involved in lifting and is organized into three parts: a POWERSTROKE experience, a POWERLIFT stance experience, and a POWERLIFT experience. In each part the teacher first explains and then demonstrates to the students that particular part of the lifting experience. The teacher then has a volunteer demonstrate that part of the lifting experience. Finally, the entire class actively performs that part of the lifting experience. While the teacher's explanations and demonstrations may involve a live lecturer or a videotape of such a lecture, it is important for the students to kinesthetically experience each exercise. If a videotape is used, the videotape provides instructions for the tape to be stopped after each part of the demonstration for the kinesthetic exercises. Since each experience involves the same steps regardless of whether it is being demonstrated by the teacher, being performed by a volunteer, or being performed by an entire class, each experience will be described where appropriate with respect only to one lifter.

Figure 1:
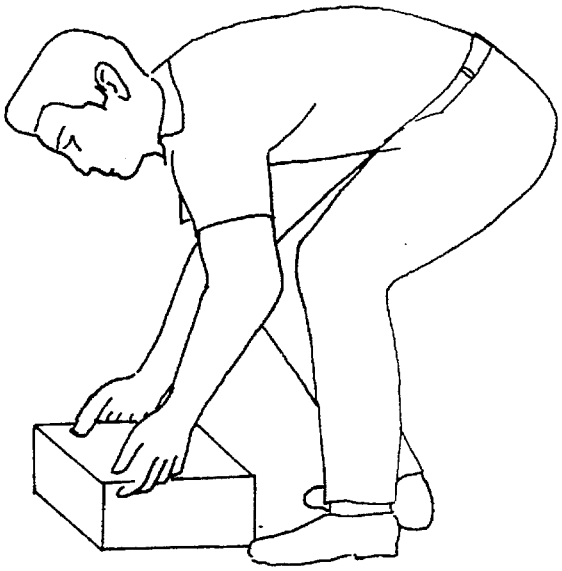
Fig. 1 PRIOR ART
FIG. 1 is a schematic illustration of a backlift technique known in prior art.
Figure 2:
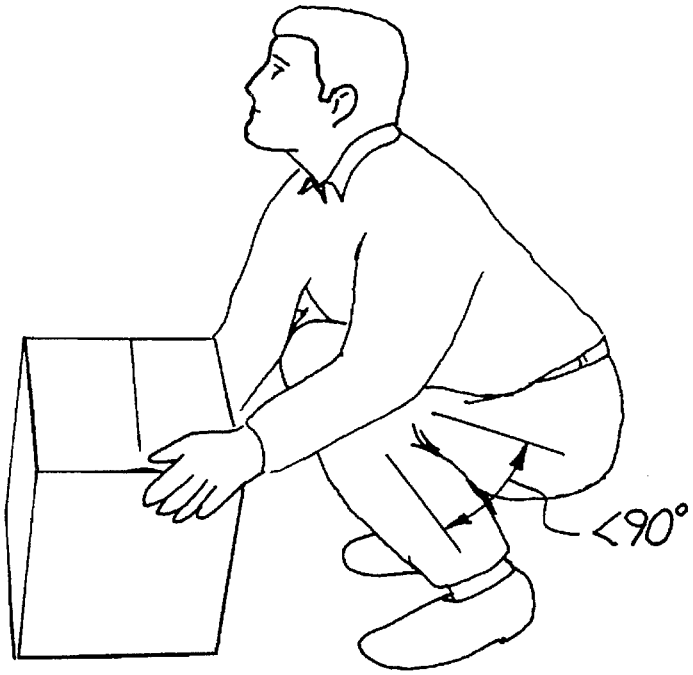
Fig. 2 PRIOR ART
FIG. 2 is a schematic drawing of a squatlift technique known in the prior art.

The lifting technique according to the invention overcomes the inadequacies of the prior art lifting techniques described above, and in particular the "backlift" technique shown in FIG. 1 and the "squatlift" technique shown in FIG. 2, in part by utilizing a stance where the feet are wider than shoulder distance apart. This stance allows the heals to remain flat on the floor as the lifter goes down for the load thus providing for a very wide and stable stance. The wider than shoulder width stance also allows the knees to be held out of the way of the load so that the load is held much closer to the center of gravity of the lifter's body. In addition, the wider than shoulder width stance accommodates a knee bend that does not exceed 90°, thereby enhancing the efficiency of the quadriceps and creating a much stronger stance. This stance also allows the leg muscles to straighten the knee joint as the lift proceeds with a much smaller expenditure of energy. Finally, a wider than shoulder width stance wherein the knees are bent only 90° to 100° unlocks the restriction imposed on pelvic tilting by the hamstring muscles and increases the lifter's range of motion at the hip joint. This eliminates the need for keeping the back straight during a lift and allows the lifter's body to pivot forward at the hip sockets and, at the same time, keep the lumbar (lower back) portion of the spine in a neutral position. Keeping the back vertically straight while lifting, even with a wider than shoulder width stance, results only in a wide stance squatlift with its inherent lack of efficiency and stability, as mentioned above.

The kinesthetic POWERSTROKE experience provides an understanding of the mechanics of lifting and the benefits of a wider than shoulder width stance. The objective of the POWERSTROKE experience is to understand the POWERSTROKE of the knee and the difference in efficiency between a shoulder width stance and a wider than shoulder width stance. Placing the feet wider than shoulder width results in a knee bend usually no greater than 100° (between 100° to 180°). This is the POWERSTROKE position of the knee which provides the maximum lifting strength and efficiency.

The kinesthetic POWERSTROKE experience begins with the lifter positioning himself in front of a chair with his feet shoulder distance apart, locking his lower back and arms, and lowering himself to the seat of the chair with his legs until his hands touch the seat of the seat. The lifter physically experiences the amount that his knees must bend when going down to touch the seat with his knees only shoulder distance apart and also the fact that his heels come off the floor in this position.

Next, the lifter spreads his feet wider than shoulder distance, locks his lower back and arms, and lowers himself to the seat of the chair in the same fashion as described above. The lifter physically experiences that his knees bend much less in this position and an explanation is provided that with the feet shoulder distance apart, the knee must bend beyond the POWERSTROKE range. In other words, the knee operates within the POWERSTROKE range only when feet are placed wider than shoulder distance apart. It is important for the lifter to undergo the POWERSTROKE experience a second time so that the additional work imposed on the lifter's leg when the lifter's feet are held shoulder distance apart is more clearly felt. Before moving on to the POWERLIFT stance experience, the lifter should understand and agree that it is definitely easier to use a wider stance then it is to use a shoulder width stance when bending at the knee.

The second part of the kinesthetic experience is to provide a comparison kinesthetic POWERLIFT stance experience. The purpose of the POWERLIFT stance experience is to provide a strength testing experience for the lifter to gain a clear understanding of how the POWERLIFT stance shifts the work of holding a load from the back to the legs, and for the lifter to feel how the POWERLIFT technique results in a stronger, safer and more efficient lift than the backlift or squatlift technique. More particularly, the objective of the POWERLIFT stance experience is for the lifter to feel the differences in lifting strength between a straight leg, shoulder-width stance and a POWERLIFT stance, and for the lifter to feel the decrease in the amount of work on the back by holding the load close to the body versus holding the load away from the body.

There are three phases to the POWERLIFT stance experience. Phase one is strength testing with the legs straight, and the feet shoulder distance apart. Phase two is strength testing in the POWERLIFT stance with the load not held close to the body. Phase three is strength testing in the POWERLIFT stance with the hands held at the sides of the body so that the load is held very close. Each phase is conducted separately with audio, visual and kinesthetic modes of information dissemination.

Phase one of the POWERLIFT stance experience begins with the lifter standing with feet placed shoulder distance apart, knees locked, hands held out in front of him, and elbows at his sides. The lifter is informed that a downward force, preferably a teacher's own bodily weight, is going to be applied on the lifter's hands and the lifter tries to resist this downward force with every muscle in his body. The lifter uses his leg muscles, stomach muscles, shoulder muscles and back muscles and to get a feel of his body working as he use these muscles. If the teacher applies this downward force, the teacher approaches the lifter, and applies a downward pressure with his arms and hands on the up-turned hands of the lifter. It is advisable for the teacher to press relatively strongly in a downward fashion in order to give the lifter a true test. The lifter is typically pulled somewhat forward, especially at the back, by the downward pressure on his upturned hands. Once the test has been completed it is explained that the load just imposed was upon the lifter's spine, thereby invoking the lower back muscles as the primary force to oppose the downward pressure.

The second phase of the POWERLIFT stance experience begins to eliminate the back muscles from the lifting activity. The lifter is asked simply to spread his feet wider than shoulder distance, to bend his knees and to raise his hands with his elbows at his sides and his palms facing upward. Once again the teacher applies a downward force to the up-turned palms of the lifter to administer the strength test. An immediate increase in the lifter's strength is detected. Again, this test may be repeated to further emphasize the feelings.

At this point there may still have been some weight being held by the lifter's back as well as his legs, because the lifter's hands were being held to far out in front of his body.

In order to eliminate the load from the back it is desirable to hold the load closer to the body. This is accomplished in the form of this test by having the lifter pull his hands back to his sides at the level of his belt, thereby holding the load much closer to the body than before. Invariably on the retest with the load held closer, the lifter becomes extremely rigid and may even be able to lift the teacher right off the floor. At this point the load is being held much more by the leg muscles and much less or not at all by the back muscles.

At this point the lifter realizes through direct kinesthetic experiences two basic facts. First, the lifter realizes that the leg and knee joint operate much more efficiently when not bent beyond a right 90° angle. Second, the lifter realizes that utilizing the knee at angles greater than 90° in combination with a wider than shoulder width stance results in a body position which is both strong and which, more importantly, takes the load off the back and transfers it to the legs.

The POWERLIFT experience is a comparison kinesthetic experience which combines the principles with the POWERSTROKE experience and the POWERLIFT stance experience. The POWERLIFT experience according to the present invention involves three components. First, a load box is approached from a corner, or in other words, from approximately a 45° angle to a side of the load box such that the last approach step places the lifter's body in a wider than shoulder width stance with the knees bent. Second, the lifter must be positioned close to the load and this is achieved by the wider than shoulder width stance and the 45° angle or corner approach, thereby allowing the lifter to get much closer to the load than would ordinarily be possible when using backlifting or squatlifting techniques. Third, lifting should be done with the legs as opposed to the back. Here again, the wider than shoulder width stance, 45° angle approach and utilization of the knee only within the POWERSTROKE range (100°–180°) allows the back to pivot forward in the hip sockets in a neutral position without the back being held its a vertically straight squatlift position. This POWERLIFT technique results in a much more efficient lift than either the backlifting (FIG. 1) or the squatlifting (FIG. 2) techniques previously described.

It is important to note that when lifting in a POWERLIFT stance the knee is only to be bent at a 100° angle. If the lifter has a 100° knee bend and still cannot reach the load, then the lifter simply pivots at the hips until he reaches it. The most common mistake that people make when lifting is overbending the knee which results if the feet are only shoulder width apart, or if the person does not pivot at the hip when going down for the load. It is important to note that the back does not have to be kept straight when lifting. The back may be held forward, even horizontal, as long as the feet are spread and knees are bent. In the POWERLIFT stance, the hamstring muscles are slack and the hips can pivot thereby keeping the back out of the lift.

Figure 3:
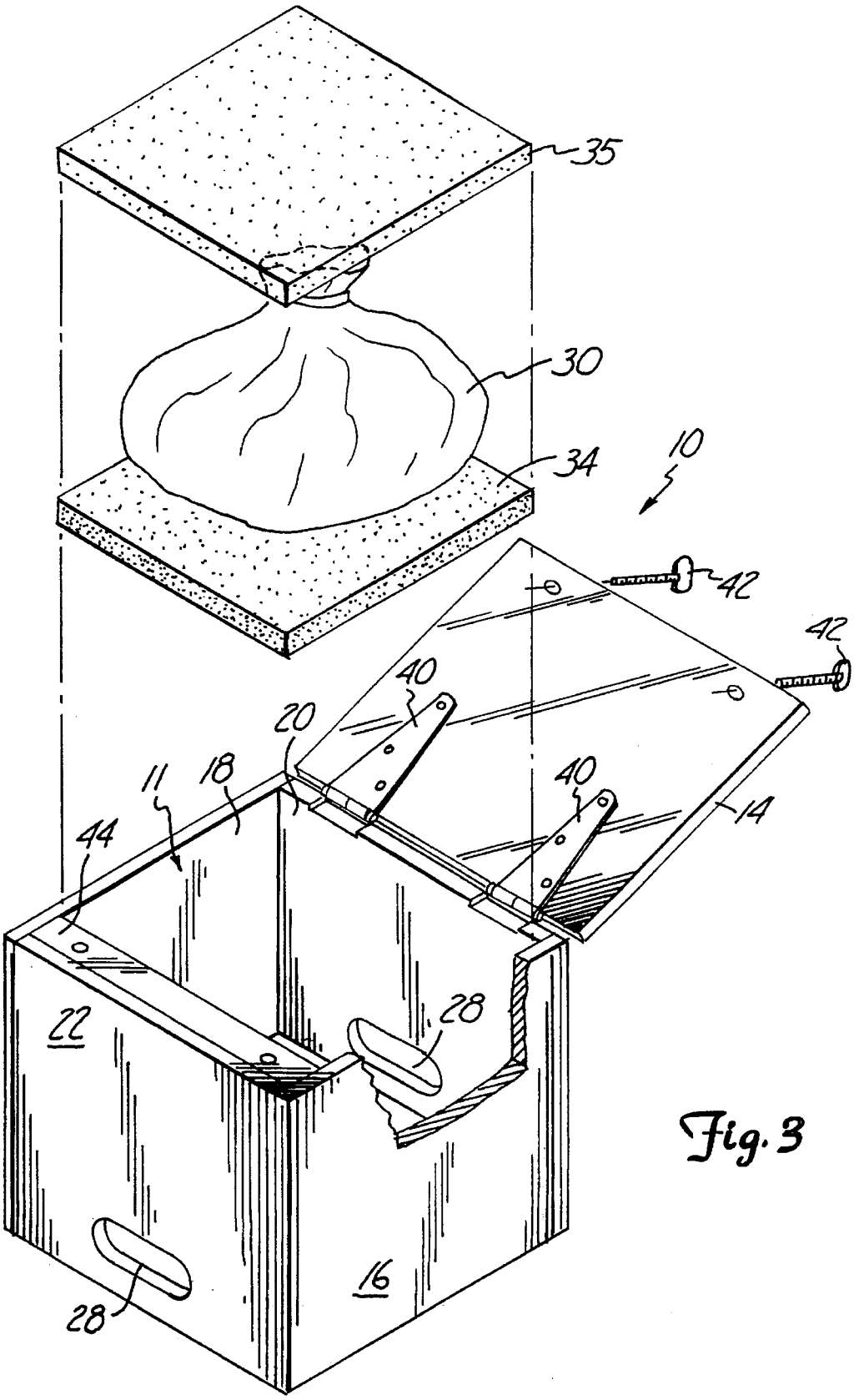
FIG. 3 is a perspective view of a lifting box for use in demonstrating a lifting technique according to the present invention.
Figure 5A:
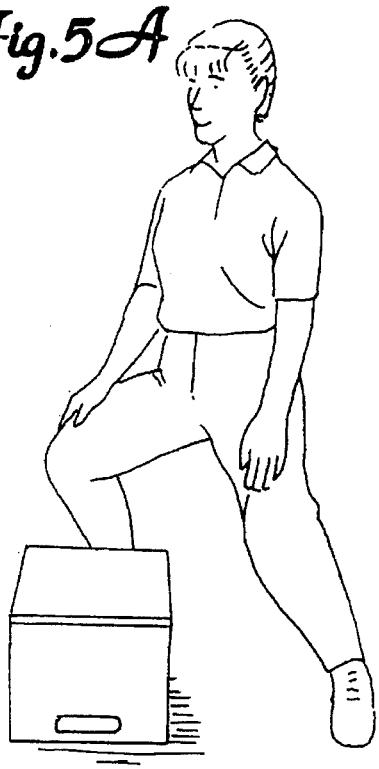
FIGS. 5A–5D are a series of schematics illustrating another lifting technique according to the present invention.
Figure 5C:
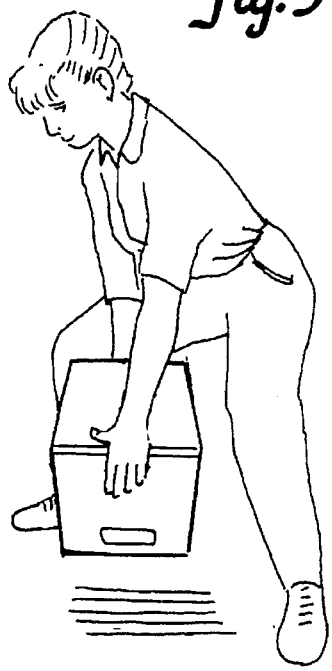

Referring to FIG. 3, the comparison kinesthetic POWERLIFT experience incorporates the use of a specially designed lifting box 10. The lifting box 10 is substantially rectangular and has an internal storage area 11 formed by a top wall 12, a bottom wall 14, a front wall 16, a back wall 18, and first and second opposed side walls 20 and 22, respectively. First and second side walls 20 and 22 each have handles 28 thereon adjacent to the top wall 12. The bottom wall 14 is movable to provide access to the internal storage area 11. The design of the lifting box 10 allows for quick customizing of lifting loads. A plurality of different weights 30 are provided ranging from 10 to 50 lbs. so that a variety of loads can be made available by opening the bottom of the box and changing the amount of weight in the internal storage area 11. Additionally, foam pads 34 and 35 are provided adjacent the top and bottom walls 12 and 14, respectively. The foam pads 34 and 36 surround the weights 30 and provide a cushion to the walls of the lifting box 10. A first end of the bottom wall 14 is attached to the first side wall 20 by a pair of hinges 40. A second end of the bottom wall is attached by bolts 42 to a support member 44 mounted to the second wall 22 for securing the bottom wall 14 to close the internal storage area 11. This fixed wall structure and the positioning of the handles 28 adjacent the top wall 12 allows the lifting box 10 to be used as a demonstration load both for lifting a load by with handles and for lifting a load without handles. This is accomplished by inverting the lifting box 10 upside down so that the handles 28 are relatively inaccessible and so that the lifter is forced to manipulate the box by tilting it on one end (as shown in FIG. 5C).

Figure 4A:
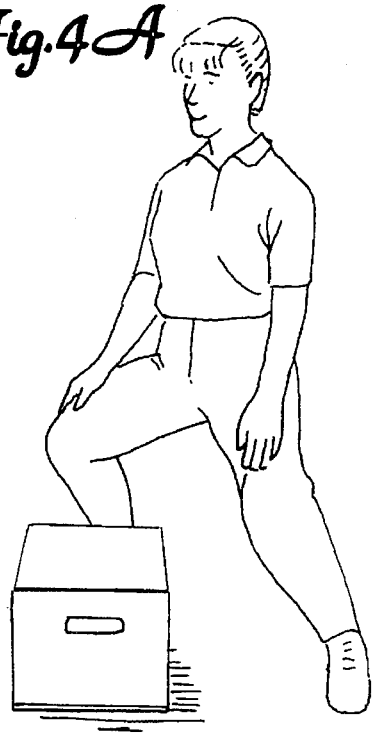
FIGS. 4A–4D are a series of schematic drawings illustrating a lifting technique according to the present invention.
Figure 4C:
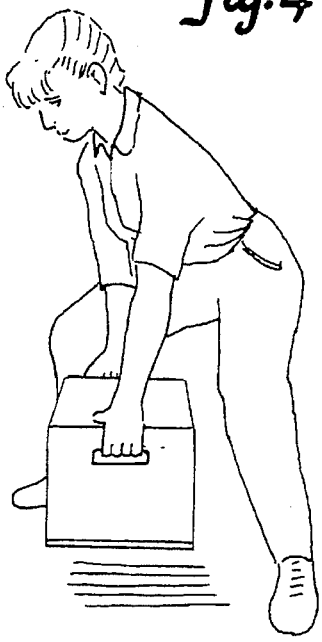
Figure 4B:
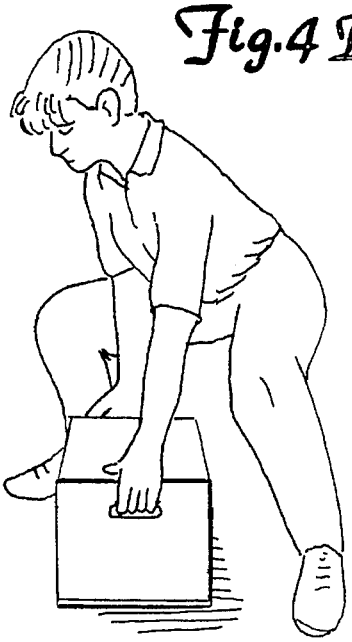
Figure 4D:
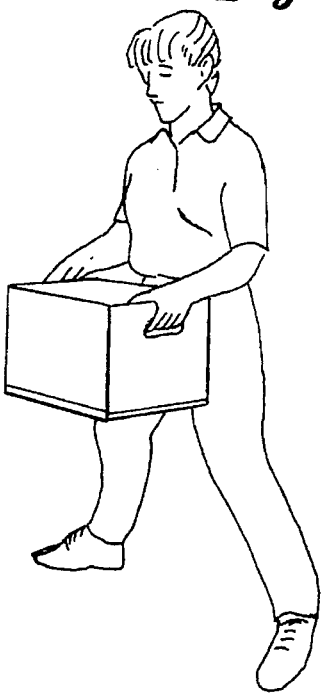

After the teacher discusses and demonstrates the three components of the POWERHFT a volunteer is selected for the comparison kinesthetic POWERLIFT experience. The volunteer is asked to approach the upright lifting box 10 and lift it without using the POWERLIFT technique. The volunteer typically lifts with either a backlift technique as shown in FIG. 1 or with a squatlift technique as shown in FIG. 2. Then, without letting the volunteer move his feet out of position, the volunteer is asked to kick a foot out to the side of the lifting box 10 to straddle a corner of the box, and come at the box from approximately a 45° angle, bend at his knees and hips as shown in FIG. 4A, grasp the handles of the box as shown in FIG. 4B, and lift the box with his legs while keeping the box close to his body as shown in FIGS. 4C and 4D. In other words, the volunteer is asked to assume the POWERLIFT stance and then lift the box using the POWERLIFT technique. The procedure is repeated wherein the volunteer is again asked to lift the box without using the POWERLIFT technique and then to again lift the box with the POWERLIFT technique to reinforce to the volunteer that he have been misusing his back and the inefficiencies and difficulties of squatlift and/or backlift technique compared to the POWERLIFT technique. At this point, if there is a large class, all of the students are asked to surround lifting boxes in a large circle wherein each student goes through the same series of four lifts wherein the first and third lifts are by the backlift or squatlift technique and the second and fourth lifts are by the POWERLIFT technique.

Figure 5B:
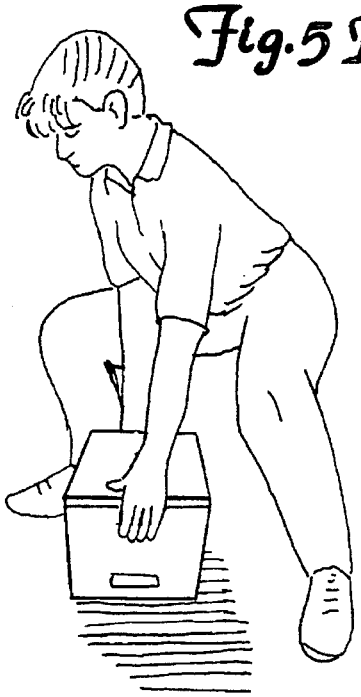
Figure 5D:
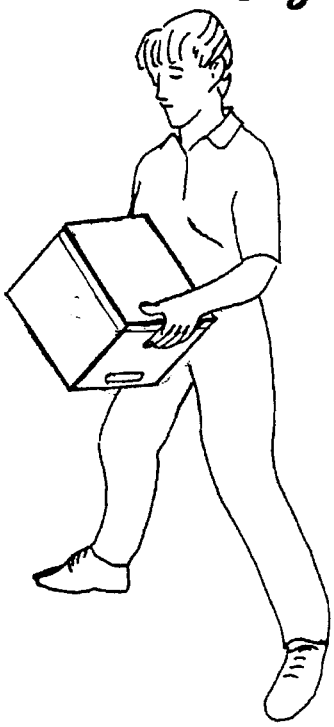

After performing a simple POWERLIFT experience on a box with handles the next step is to lift a box not having handles. As shown in FIGS. 5A–5D, in order to simulate such a box, the lifting box 10 is inverted such that the handles 28 are adjacent the ground surface. Conventional techniques for lifting boxes without handles involve reaching for the bottom of the box and then lifting the box upward in a "deadlift". In order to ease the lifting of such boxes, the lifting box 10 is tipped on one end (see FIG. 5C) so that the tipped end has now been moved upward from the ground surface thereby raising the center of gravity of the lifting box 10 and reducing the amount of stress on the back muscles. More particularly, the lifting box 10 is approached from approximately a 45° angle and the lifter assumes a POWERLIFT stance over the lifting box 10, bending at the knees and hips as shown in FIG. 5A. Next, the lifter grasps the two opposite corners of the lifting box 10 and tips the box on its side as shown in FIG. 5B. Finally, the lifter reaches for the bottom of the lifting box 10 which has now been tipped upward and lifts the lifting box 10 upward using his legs as shown in FIGS. 5C and 5D.

If the box is large and bulky then it may be rotated into the persons body as the load is raised. It is important to understand that the POWERLIFT concept may be adapted for a variety of loads and for lifting such loads from a variety of locations. For example, when lifting objects from cars, a foot may be placed on the floor board or in the trunk to maintain the wider than shoulder width stance. Once the load is initially moved from such hard to reach locations, the lifter may return to the traditional POWERLIFT stance and remove the load.

Although the present invention has been described with reference to preferred embodiments, workers skilled in the art will recognize that changes may be made in form and detail without departing from the spirit and scope of the invention.

What is claimed is:

1. A process for demonstrating a lifting technique to a person, the process comprising the steps of:

providing a substantially rectangular box in a first stationary position on a ground surface, the box having an internal storage area means for receiving a plurality of weights therein, the internal storage area means formed by a top wall, a bottom wall, a front wall, a back wall, and first and second opposed side walls, the first and second side walls each having handles thereon adjacent the top wall, the bottom wall contacting the ground surface in the first stationary position, the bottom wall being movable to provide access to the internal storage area means;

inserting at least one weight into the internal storage area means, wherein the internal storage area means receives said plurality of weights therein to selectively change the weight of the box and the resistance one's body perceives when raising and lower the box from the first stationary position and to the first stationary position, the bottom wall having a securing means such that the at least weight is contained within the box when the box is lifted;

approaching two perpendicular sides of the box, wherein one of the perpendicular sides is one of the front or back walls, in the first stationary position at approximately a 45° angle such that one's feet are wider than shoulder distance apart when one is adjacent the box;

bending one's knees such that one's body is close to the box;

lifting the box from the first stationary position using the handles; and returning the box to the first stationary position,

2. The process of claim 1, further comprising the steps of:

inverting the box to a second stationary position wherein the handles are not readily accessible;

approaching two perpendicular sides of the box, wherein one of the perpendicular sides is one of the front or back walls, at approximately a 45° angle such that one's feet are wider than shoulder distance apart when one is adjacent the box;

bending one's knees such that one's body is close to the box; and lifting the box without using the handles.

3. The process of claim 2, further comprising the steps of:

inserting a second weight into the internal storage area means;

approaching two perpendicular sides of the box, wherein one of the perpendicular sides is one of the front or back walls, at approximately a 45° angle such that one's feet are wider than shoulder distance apart when one is adjacent the box;

bending one's knees such that one's body is close to the box; and lifting the box.

4. The process of claim 2, further comprising the steps of:

approaching a side of the box in the first stationary position at approximately 90° angle such that one's feet are shoulder distance apart when one is adjacent the box;

squatting down to the box;

lifting the box from the first stationary position using the handles;

returning the box to the first stationary position;

inverting the box to a second stationary position wherein the handles are not readily accessible;

approaching a side of the box at approximately a 90° angle such that one's feet are shoulder distance apart when one is adjacent the box;

squatting down to the box; and lifting the box without using the handles.

5. A method for demonstrating a lifting technique to a person, the method comprising the steps of:

providing one with a first comparison kinesthetic experience by having one bend at the knees both first with a shoulder width stance and then with a wider than shoulder width stance to experience a difference in the amount of work required by the leg and knee;

providing one with a second comparison kinesthetic experience by having one support a load with one's hands first with a shoulder width stance and then with a wider than shoulder width stance to experience the increase in strength derived from a wider than shoulder width stance compared to a shoulder width stance and experience the load shift from one's back to one's legs when a wider than shoulder stance is used; and providing one with a third comparison kinesthetic experience by having one lift a box by approaching two perpendicular sides of the box from approximately a 45° angle, wherein one of the perpendicular sides is one of a front wall or a back wall of the box, and wherein the box includes a top wall, a bottom wall, a front wall, a back wall, and first and second opposed side walls, the first and second side walls each having handles thereon adjacent to the top wall, the bottom wall being movable to provide access to an internal storage area means for receiving at least one of a plurality of weights therein to selectively change the weight of the box and the resistance one's body perceives when raising and lowering the box, wherein the bottom wall has a securing means such that said at least first weight is contained within the box when the box is lifted, spreading one's feet wider than shoulder width around the box, bending one's knees, positioning one's body close to the box, lifting the box with one's legs, and lowering the box with one's legs, then lifting the box with a stance shoulder width apart by approaching one of said sides of the box from approximately a 90 degree angle to experience the first parts of both the first and second kinesthetic experiences at the same time.

6. The method of claim 5, wherein the box is a substantially rectangular box having an internal storage area formed by a top wall, a bottom wall, a front wall, a back wall, and first and second opposed side walls, the first and second side walls each having handles thereon adjacent the top wall such that in an upright position the box is lifted using the handles and such that in an inverted position the box is lifted without using the handles.

7. The method of claim 6, wherein the bottom wall of the box is hinged to the box to permit the removal and insertion of weights in an internal storage area formed within the box by the top wall, bottom wall, front wall, back wall, and first and second side walls.

8. The method of claim 5, wherein the first comparison kinesthetic experience includes the steps of:

standing in front of a box with one's feet shoulder distance apart, back straight and elbows locked;

bending at the knees until one's hands contact the box;

standing in front of the box with one's feet wider than shoulder distance apart;

bending at the knees until one's hands contact the box;

determining the amount of knee bend with one's knees wider than shoulder distance apart compared to when one's knees were shoulder distance apart.

9. The method of claim 5, wherein the second comparison kinesthetic experience includes the steps of:

causing a force to be applied to one's legs with one's feet shoulder distance apart; 'causing a force to be applied to one's legs with one's feet wider than shoulder distance apart;

experiencing the reduced effort required to resist the force when one's feet are wider than shoulder distance apart.

10. The method of claim 5, wherein the box in the third comparison kinesthetic experience has handles.

11. The method of claim 5, wherein the box in the third comparison kinesthetic experience has no handles, and wherein the third comparison kinesthetic experience further includes the step of tipping the box onto one of its sides before lifting the box.

12. The method of claim 5, wherein the third comparison kinesthetic experience further includes rotating the box after the box has been lifted to keep the box close to one's body.

* * * * *

UNITED STATES PATENT AND TRADEMARK OFFICE

CERTIFICATE OF CORRECTION

PATENT NO. : 5,498,162

DATED : March 12, 1996

INVENTOR(S) : MICHAEL J. SCHAEFER

It is certified that error appears in the above-indentified patent and that said Letters Patent is hereby corrected as shown below:

Col. 2, line 12, delete "POWERLIFF", insert --POWERLIFT--

Col. 2, line 13, delete "POWERLIFF", insert --POWERLIFT--

Col. 6, LINE 18, DELETE "POWERHFT", insert --POWERLIFT--

Col. 7, line 32, delete "lower", insert --lowering--

Col. 7, line 35, after "least", insert --one--

Col. 8, line 33, after "and", insert --to--

Signed and Sealed this

Sixteenth Day of July, 1996

*Attest:*

Bruce Lehman

BRUCE LEHMAN

*Attesting Officer*

*Commissioner of Patents and Trademarks*